US008436281B2

(12) United States Patent
Cretors

(10) Patent No.: US 8,436,281 B2
(45) Date of Patent: May 7, 2013

(54) FOOD HEATERS WITH REMOVABLE ROLLERS

(75) Inventor: Charles D. Cretors, Lake Forest, IL (US)

(73) Assignee: C. Cretors & Company, Chicago, IL (US)

( * ) Notice: Subject to any disclaimer, the term of this patent is extended or adjusted under 35 U.S.C. 154(b) by 470 days.

(21) Appl. No.: 12/650,181

(22) Filed: Dec. 30, 2009

(65) Prior Publication Data

US 2010/0170885 A1 Jul. 8, 2010

Related U.S. Application Data

(60) Provisional application No. 61/141,932, filed on Dec. 31, 2008.

(51) Int. Cl.
*H05B 1/02* (2006.01)

(52) U.S. Cl.
USPC ..... 219/494

(58) Field of Classification Search ..... 219/483–505
See application file for complete search history.

(56) References Cited

U.S. PATENT DOCUMENTS

| | | | | |
|---|---|---|---|---|
| 4,516,485 | A | 5/1985 | Miller | |
| 4,982,657 | A | 1/1991 | Ghenic | |
| 5,117,748 | A | 6/1992 | Costa | |
| 5,533,440 | A | 7/1996 | Sher | |
| 5,611,263 | A | 3/1997 | Huang | |
| 6,393,971 | B1 | 5/2002 | Hunot et al. | |
| 6,575,083 | B2 | 6/2003 | Haas et al. | |
| 6,800,314 | B2 * | 10/2004 | Evans et al. | 219/214 |
| 7,377,209 | B2 | 5/2008 | Perttola | |
| 7,591,220 | B2 * | 9/2009 | Sheridan, Jr. | 99/441 |
| 7,658,143 | B2 | 2/2010 | Cretors | |
| 8,148,669 | B2 * | 4/2012 | Schwierking et al. | 219/494 |

FOREIGN PATENT DOCUMENTS

WO WO-9215183 A1 9/1992

OTHER PUBLICATIONS

Gold Medal Products Co.; "Funfood Equipment & Supplies" catalog; vol. 56, dated 2000, 108 pages.
Proctor Companies; Equipment Catalog, 1992, 33 pages.
Proctor Companies; "Concession Stands and Equipment" catalog, vol. 3, 1996, 84 pages.
U.S. Appl. No. 12/640,314, filed Dec. 17, 2009, Cretors.
International Search Report and Written Opinion for PCT/US05/42059; Applicant: C. Cretors and Company; Date of Mailing: Nov. 22, 2006, 8 pages.

* cited by examiner

*Primary Examiner* — Cuong Q Nguyen
(74) *Attorney, Agent, or Firm* — Perkins Coie LLP

(57) ABSTRACT

Food heating devices and methods of removing one or more rollers from food heating devices are disclosed herein. An embodiment of a food heating device configured in accordance with the present disclosure includes a base structure, a food rotating system, a food heating system, and a plurality of rollers. One end of a roller can be left unsupported, either by separating a sidewall of the base structure or by separating an insert from the sidewall. In turn, an opposite end of the roller can be disconnected from the food rotating system, and the roller can be displaced axially with respect to the food heating system, which remains fixed relative to base structure. Accordingly, the roller(s) can be removed, cleaned separately, and subsequently reinstalled or replaced with respect to the base structure.

15 Claims, 8 Drawing Sheets

FOOD HEATERS WITH REMOVABLE ROLLERS

CROSS-REFERENCE TO RELATED APPLICATION(S)

This patent application claims the benefit under 35 U.S.C. §119 of U.S. Provisional Patent Application No. 61/141,932, filed on Dec. 31, 2008, entitled "Food Heaters with Removable Rollers." That application is incorporated herein in its entirety by reference.

TECHNICAL FIELD

The present disclosure relates generally to devices for heating and/or cooking food. In particular, the present disclosure relates to devices for heating and/or cooking food, e.g., hot dogs, sausages, etc., that rotate the food.

BACKGROUND

Conventional devices for heating hot dogs include tubular rollers that support the hot dogs. Electric heating elements positioned inside the rollers heat the rollers, and a drive mechanism coupled to the rollers turns the rollers. The hot dogs supported on the rollers are rotated and heated due to contact with the rollers. As the hot dogs are heated, the rollers can be become covered with juices that naturally cook out of the hot dogs. One downside of conventional hot dog heating devices, however, is that they cannot be cleaned by submersion in a cleaning fluid insofar as the heating elements inside the rollers and other electrical components can be shorted-out or damaged by the cleaning fluid. As a result, more laborious cleaning methods are often employed.

DETAILED DESCRIPTION

Figure 1:
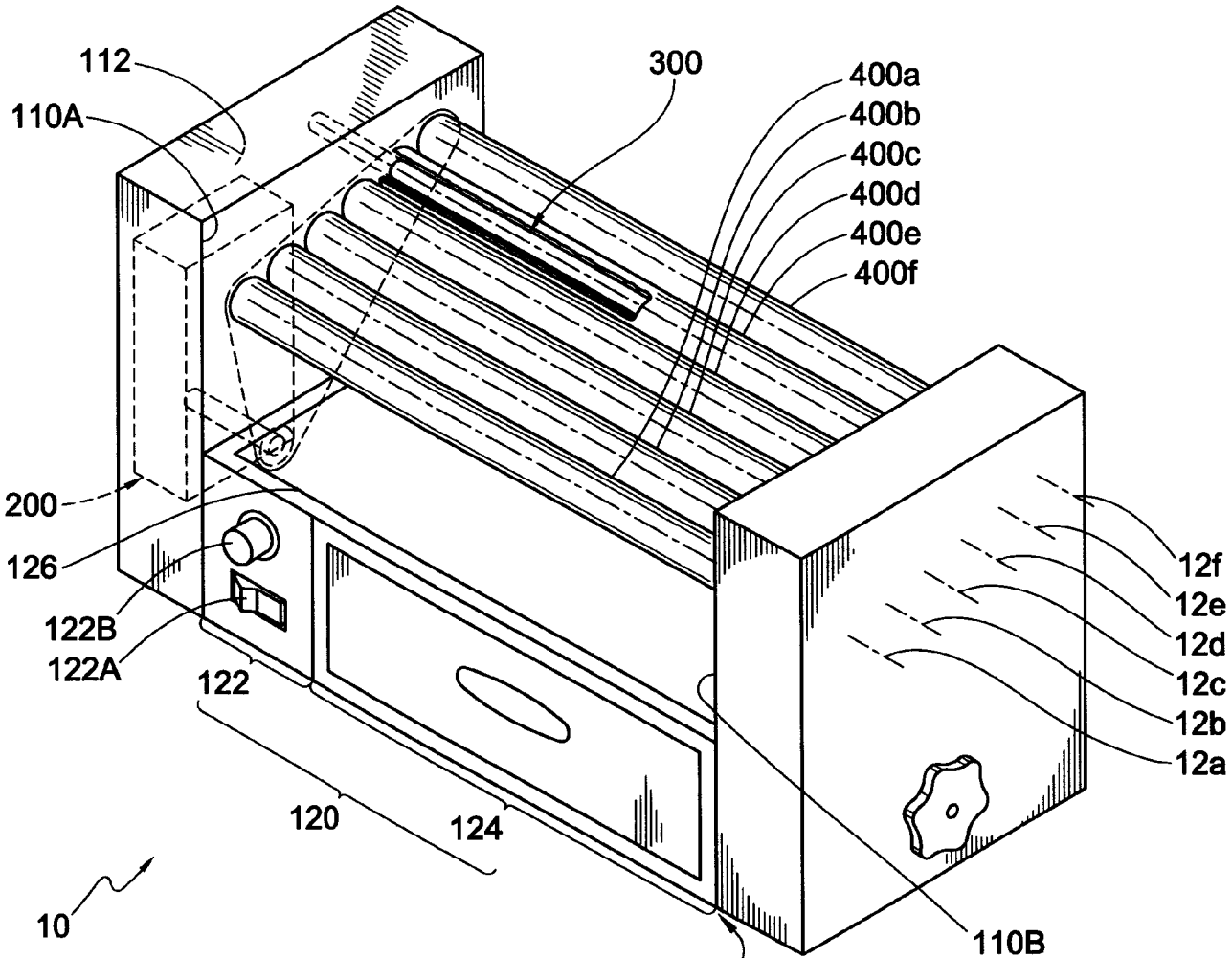
FIG. 1 is an isometric view, with a partial cut-away, of a food heater according to an embodiment of the present disclosure.

The following disclosure describes several embodiments of food heating devices. The food product being heated according to the present disclosure can include hot dogs, sausage links, bratwurst, other forms of encased meat, or any kind of food that can be prepared by rotation or other movement with a heated roller. Specific details of several embodiments of the present disclosure are described below with reference to FIGS. 1 to 6B to provide a thorough understanding of the embodiments. Other details describing well-known structures and systems often associated with heating or cooking food, however, are not set forth below to avoid unnecessarily obscuring the description of the various embodiments. Accordingly, those of ordinary skill in the art will understand that the invention may have other embodiments in addition to those described below. Such embodiments may include other elements and features in addition to those described below, or they may lack one or more of the features or elements described below.

Aspects of the present application are generally directed toward apparatuses for heating food. One aspect of certain embodiments includes a base including a first sidewall spaced from a second sidewall, a plurality of rollers configured to support food and extending between the first and second sidewalls, a driving system configured to rotate at least one roller with respect to the base for rotating the food, at least one heater configured to heat the at least one roller for heating the food, and at least one support configured to rotatably couple the second ends of the individual rollers to the second sidewall in a first arrangement. The individual rollers extend along corresponding individual axes between a first end proximate the first sidewall and a second end proximate the second sidewall. The driving system includes a drive unit and a plurality of driven units. The individual driven units are supported by the first sidewall and selectively configurable in the first arrangement to be operably coupled to the first end of a corresponding individual roller and in a second arrangement to be decoupled from the first end of the corresponding individual roller. The plurality of driven units operably couples the drive unit to the plurality of rollers when the driven units are in the first arrangement. The least one support is also configured to decouple the second ends of the individual rollers from the second sidewall in the second arrangement.

Other aspects of certain embodiments include a base, a plurality of rollers rotatably supported by the base in a heating arrangement, a driving system configured to rotate at least one roller for rotating the food in the heating arrangement, means for temporarily disconnecting the at least one roller from the drive system in a cleaning arrangement, means for moving the at least one roller away from the base in the cleaning arrangement, and means for reconnecting the at least one roller to the drive system in the heating arrangement.

Other aspects of the present application are generally directed toward methods for cleaning a food heater. The food heater includes a plurality of rollers for heating and rotating a food, and individual rollers extend along individual axes between first and second sidewalls One aspect of certain embodiments includes disconnecting a first end of at least one roller from the first sidewall, disconnecting a second end of the at least one roller from a rotary drive system at the second sidewall, displacing the at least one roller from the second sidewall, and immersing the at least one roller in a first cleaning solution.

FIG. 1 is an isometric view of a food heater 10 configured in accordance with an embodiment of the disclosure. The food heater 10 includes a base structure 100, a food rotating system 200, a food heating system 300 (a portion of which is shown in the cut-away in FIG. 1), and a plurality of rollers 400. The rollers 400 (individual rollers 400*a* to 400*f* are shown in FIG. 1) extend along parallel, spaced axes 12 (individual axes 12*a* to 12*f* are shown in FIG. 1). There are six axes in the embodiment shown in FIG. 1; however, other embodiments according to the present disclosure can include two or more axes. In accordance with another embodiment of the disclosure, food may be heated and/or cooked using an inductive foot heating system such at that described in U.S. patent application Ser. No. 12/640,314, filed on Dec. 17, 2009, entitled "Apparatus and Method for Inductively Applying Heat to Food." That application is incorporated herein in its entirety by reference.

The base structure 100 includes walls 110 (first sidewall 110A and second sidewall 110B are shown in FIG. 1) to support the rollers 400. The spacing between the walls 110 can be selected so as to correspond to the number and size of the food product that is to be heated. For example, three six-inch long hot dogs can be placed end-to-end between walls that are spaced approximately 20 inches from one another Any suitable wall spacing can be selected in accordance with the number and size of products to be heated. In other embodiments, one or more intermediate walls (not shown) may be disposed between the first and second sidewalls 110A and 110B to provide support for different sets of the rollers 400.

In the embodiment shown in FIG. 1, individual walls 110 include a corresponding interior volume 112 that can house, for example, at least a portion of the rotating system 200, etc. Accordingly, the wall 110 can enclose the rotating system 200 and thereby separate the rotating system 200 from the rollers 400, which can reduce, for example, drippings off the rollers 400 contacting the rotating system 200, lubricants off the rotating system contacting the rollers 400, etc. In other embodiments, other components of the food heater 10 can additionally or alternatively be positioned in the interior volume 112 such that the wall 110 can provide a barrier that limits exposure between the food product being heated on the rollers 400 and one or more operating components of the food heater 10. In still other embodiments, the walls 110 can have any suitable arrangement, e.g., a plate, that supports the rollers 400.

The base structure 100 can also include enclosures, spacers, webs, beams, panels, or any suitable structure that extends between and establishes the relative position of the walls 110. In the embodiment of the present disclosure shown in FIG. 1, an enclosure 120 adjoins lower portions of the walls 110. The enclosure 120 can include a control section 122 and a storage section 124. The control section 122 of the enclosure 120 can include, for example, a first control 122A for the rotating system 200 and a second control 1228 for the heating system 300. The storage section 124 can include, for example, a bread or bun warming compartment, etc.

As shown in FIG. 1, the base structure 100 can also include a removable tray 126 positioned over the enclosure 120 and between the walls 110. Typically, the tray 126 is positioned beneath the food product so as to collect drippings from the food product. The tray 126 is removable for ease of cleaning relative to the enclosure 120.

Figure 2:
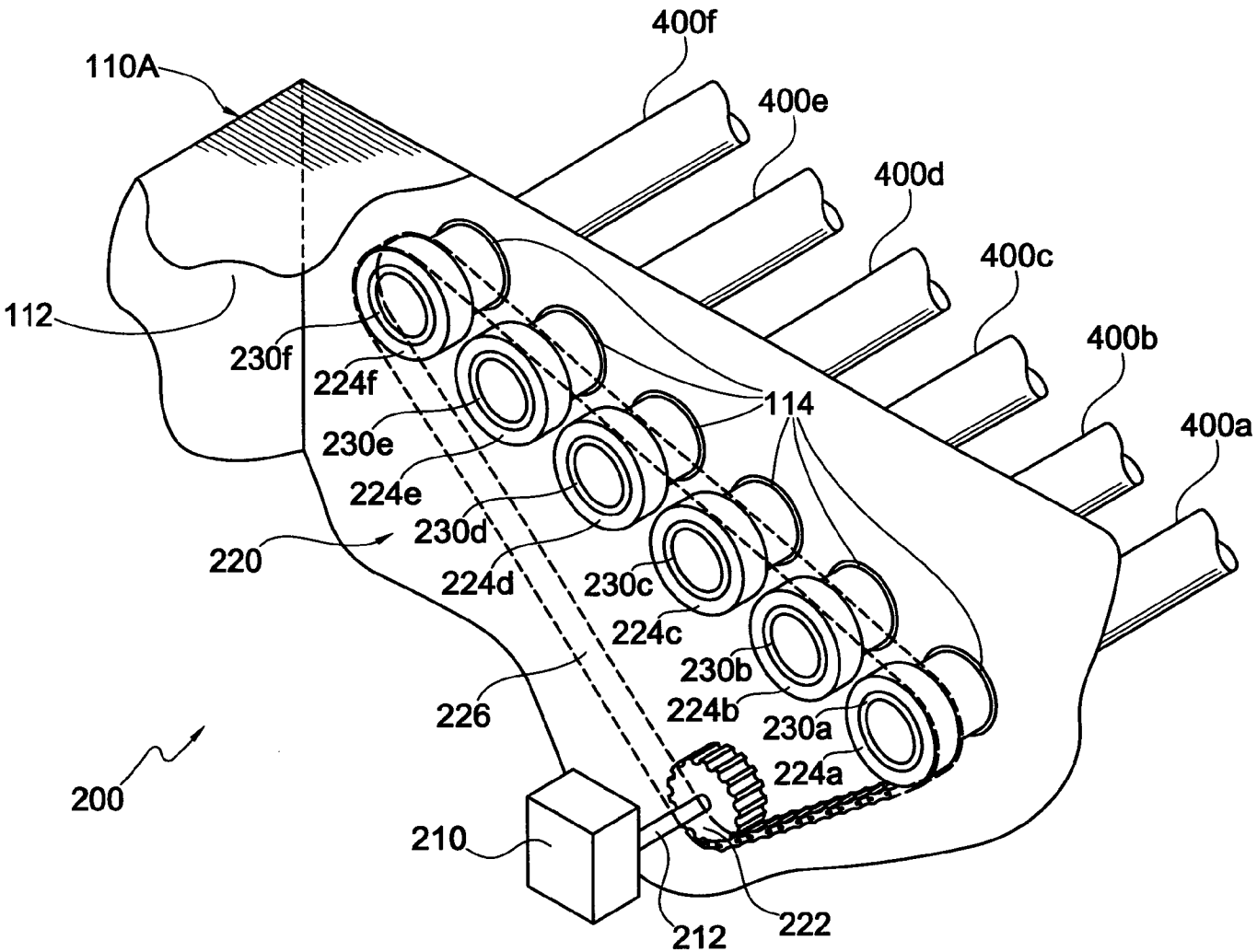
FIG. 2 is an isometric detail view showing a food rotating system of the food heater shown in FIG. 1.

FIG. 2 is an enlarged view illustrating certain details of the food rotating system 200. The rotating system 200 can include an actuator 210, a drive arrangement 220, and a plurality of connectors 230 (individual connectors 230*a* to 230*f* are shown in FIG. 2). The actuator 210 (shown schematically in FIG. 2) is typically an electric gearmotor, but can be any suitable device that causes the rollers 400 to rotate at a desired speed. In the illustrated embodiment, the drive arrangement 220 includes a drive sprocket 222, a plurality of driven sprockets 224 (individual driven sprockets 224*a* to 224*f* are shown in FIG. 2), and a drive chain 226 (e.g., a metal roller chain). The drive sprocket 222, driven sprockets 224 and drive chain 226 are shown partially schematically in FIG. 2. The drive sprocket 222 is operably coupled to the actuator 210, e.g., fixed to an output shaft 212. The individual driven sprockets 224 are operably coupled to a corresponding roller 400 by an individual connector 230 and can be supported by a bearing 114 for relative rotation with respect to the sidewall 110A. The drive chain 226 operably couples the drive sprocket 222 to the driven sprockets 224. In other embodiments of the present disclosure, the drive arrangement 220 can include pulleys and a belt, a gear train, or other drive systems that are suitable for conveying rotation from the actuator 210 to the rollers 400.

Individual connectors 230 operably couple individual driven sprockets 224 to corresponding rollers 400. The connectors 230 can include any suitable arrangement of one or more screw threads, projections, surfaces, etc. that cooperatively engage with one or more grooves, slots, holes, surfaces, etc. to convey torque from the driven sprocket 224 to the roller 400. The connectors 230 can also include magnetic couplings or other fields, links, etc. to convey torque from the driven sprocket 224 to the roller 400. Four embodiments of connectors 230 will now be described with reference to FIGS. 3A to 3D.

Figure 3A:
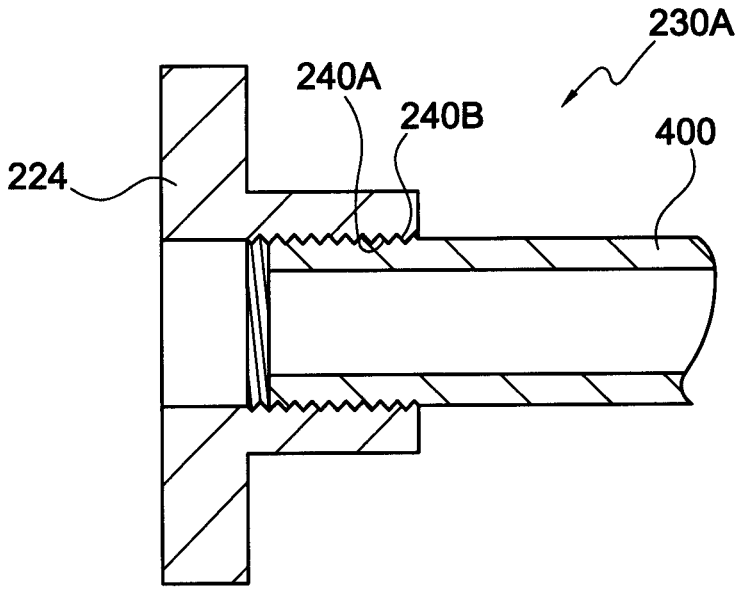
FIG. 3A is a cross-sectional view illustrating a first embodiment of a connector according to the present disclosure.

FIG. 3A shows details of a first embodiment of an individual connector 230A according to the present disclosure. The connector 230A includes an internal thread 240A positioned on the driven sprocket 224 and matingly engaging an external thread 240B positioned on the roller 400. The "hand," e.g., right-hand or left-hand, of the internal and external threads 240A and 240B can be selected so as to avoid or prevent the torque of the actuator 210 (not shown) from tending to uncouple the connector 230A. To couple or uncouple the connector 230A, movement of the drive arrangement 220 (not shown) can be restricted or prevented so as to provide a reaction force while the roller 400 is turned.

Figure 3B:
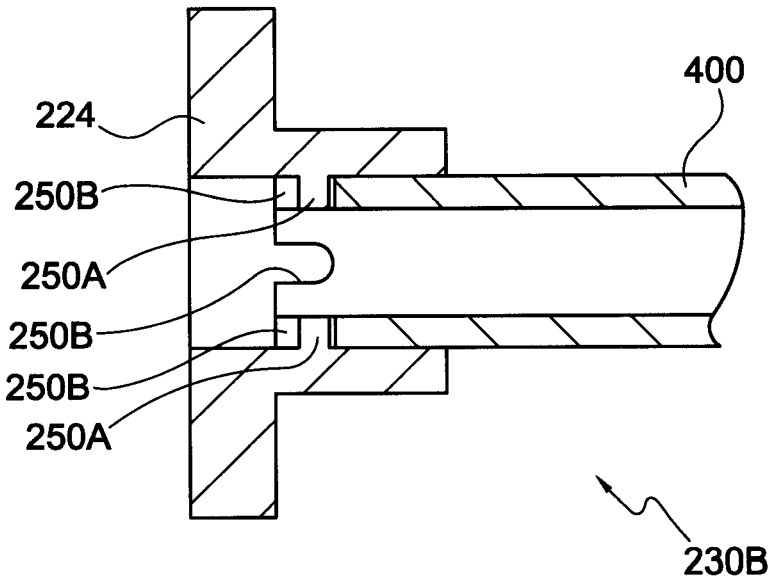
FIG. 3B is a cross-sectional view illustrating a second embodiment of a connector according to the present disclosure.

FIG. 3B shows details of a second embodiment of an individual connector 230B according to the present disclosure. The connector 230B includes one or more radial projections 250A (two are shown in FIG. 3B) positioned on the driven sprocket 224 and matingly engaging corresponding slots 250B positioned on the roller 400. The number of the slots 250B should be at least as great as the number of projections 250A, and the relative angular orientation of the projections 250A around the driven sprocket 224 should correspond to at least one set of slots 250B on the roller 400. In the embodiment shown in FIG. 3B, the roller 400 is telescopically received in the driven sprocket 224 and axial displacement of the roller 400 away from the driven sprocket 224 is avoided or prevented in the coupled arrangement of the connector 230B. In other embodiments, the driven sprocket 224 can be telescopically received in the roller 400.

Figure 3C:
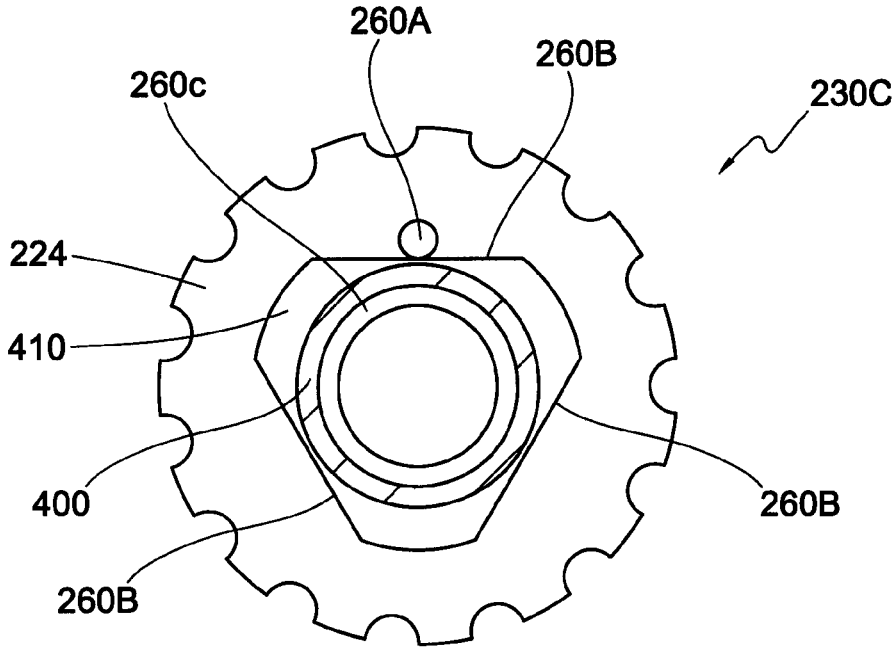
FIG. 3C is an axial end view illustrating a third embodiment of a connector according to the present disclosure.

FIG. 3C shows details of a third embodiment of an individual connector 230C according to the present disclosure. The connector 230C includes one or more axial projections 260A (one is shown in FIG. 3C) positioned on the driven sprocket 224 and engaging a corresponding flat 260B (three are shown in FIG. 3C) positioned on the roller 400. As shown in FIG. 3C, the roller 400 can include a flange 410 on which the flats 260B are provided. The flange 410 is shown projecting radially outward but may project radially inward in other embodiments. In the embodiment shown in FIG. 3C, the connector 230C can further include a tube 260C that extends axially from the driven sprocket 224 so as to be concentrically received in the roller 400. In other embodiments, the tube 260C could receive the roller 400, the tube 260C could extend axially from the roller 400, or any other arrangement that is suitable for coaxially positioning the driven sprocket 224 and the roller 400. As with the second embodiment shown in FIG. 3B, axial displacement of the roller 400 away from the driven sprocket 224 is avoided or prevented in the coupled arrangement of the connector 230C.

Figure 3D:
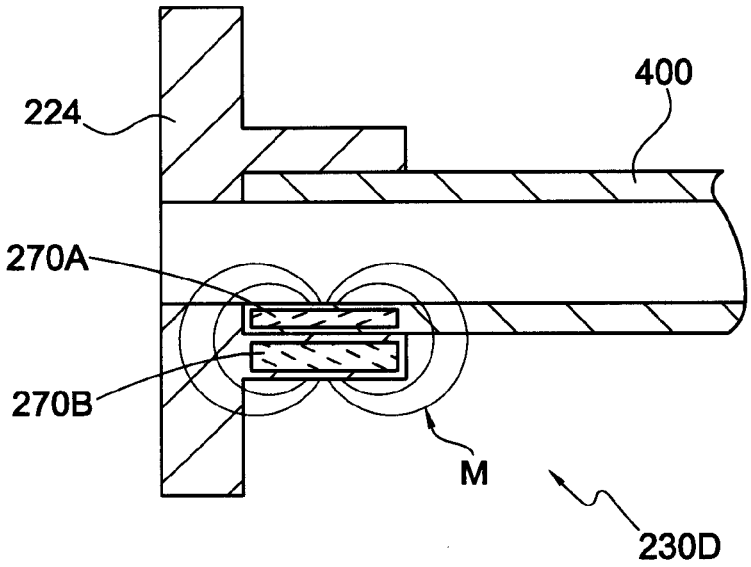
FIG. 3D is a partial cross-sectional view illustrating a fourth embodiment of a connector according to the present disclosure.

FIG. 3D shows details of a fourth embodiment of an individual connector 230D according to the present disclosure. The connector 230D includes a magnetic field, shown symbolically at M, to couple the driven sprocket 224 to the roller 400. According to one embodiment, magnetic material 270A is positioned on the driven sprocket 224 and a magnet 270B is positioned on the roller 400. The magnet 270B can be a permanent magnet or can be electrically or magnetically induced. In other embodiments, the driven sprocket 224 can include the magnet 270B and the roller 400 can include the magnetic material 270A. As with the third embodiment shown in FIG. 3C, a tube 270C can coaxially position the driven sprocket 224 and the roller 400.

Figure 4:
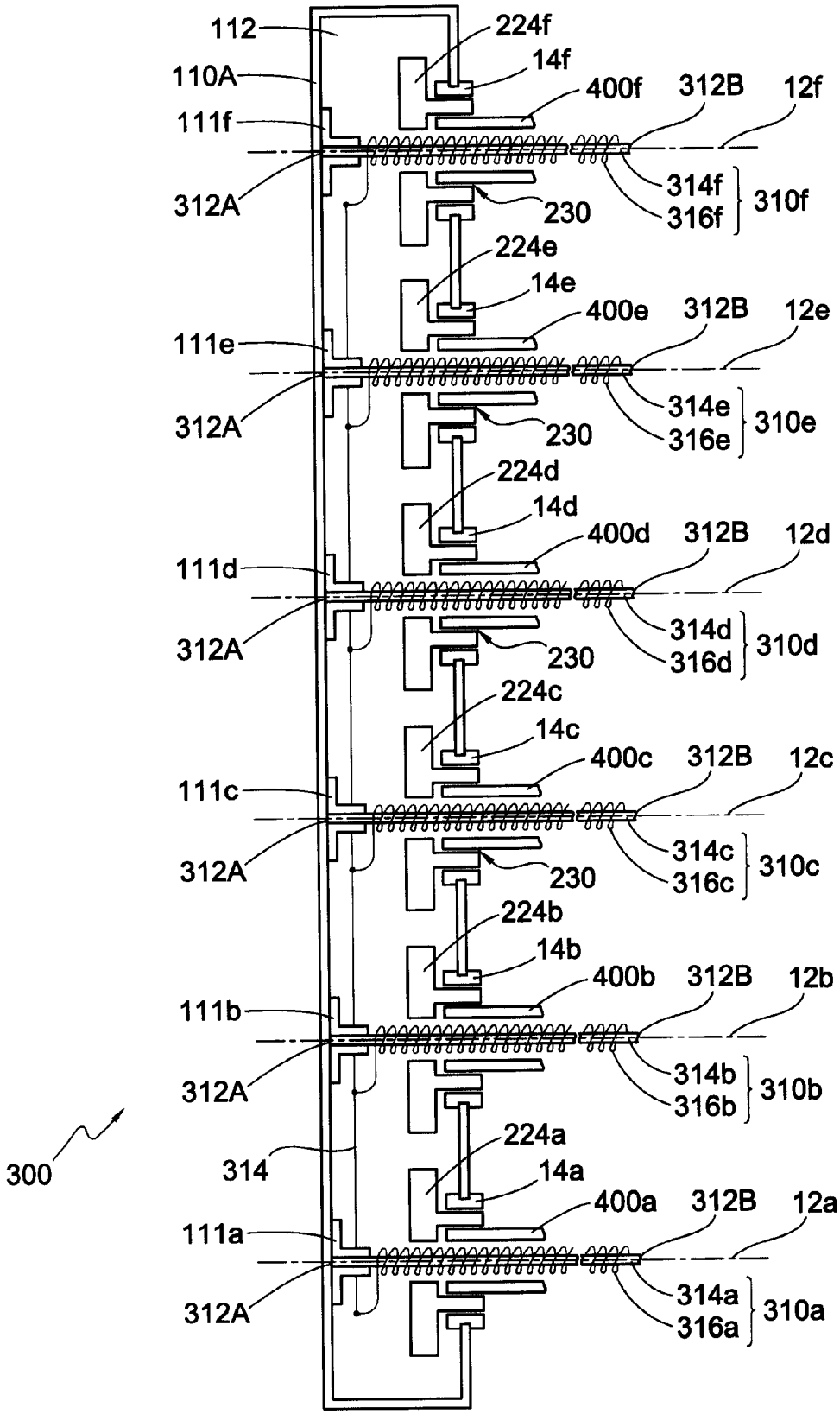
FIG. 4 is a partial schematic view showing a food heating system of the food heater shown in FIG. 1.

FIG. 4 shows details of the food heating system 300 according to an embodiment of the present disclosure. The food heating system 300 can include heating elements 310 (individual heating elements 310*a* to 310*f* are shown in FIG. 4) positioned within a corresponding roller 400. Individual heating elements 310 extend generally parallel to a corresponding axis 12 between a first end 312A and a second end 312B. In the embodiment shown in FIG. 4, the first end 312A of the heating element 310 is fixedly supported on the sidewall 110A by, e.g., a bracket 111 (individual brackets 111*a* to 111*f* are shown in FIG. 4) and can be electrically coupled by wiring 314 to a supply of electricity (not shown) to energize the heating element 310. The bearing 114 supports the driven sprocket 224, the connector 230, and the roller 400 for relative rotation with respect to the heating element 310.

In the embodiment shown in FIG. 4, the heating element 310 includes a cantilever arm 314 supporting an electrical resistance heating wire 316. The cantilever arm 314 can provide structural rigidity to minimize or avoid deflection of the second end 312B of the heating element 310 when supported by the sidewall 110A. The heating wire 316 converts electricity to heat that can be conveyed via the roller 400 to a food product F.

Typically, the electrical requirements of the heating system 300 can include alternating current voltage requirements that range from approximately 110 to approximately 240 volts (VAC) and power requirements that range from less than 1,000 Watts (W) to 3,000 W or more. The electrical requirements of individual heating elements 310 can be fractions of the electrical requirements of the heating system 300. For example, the embodiment shown in FIG. 4 includes six heating elements 310*a* to 310*f* that can have individual electrical requirements of 275 W at 120 VAC, and therefore the electrical requirements of the heating system 300 would be 1,650 W at 120 VAC.

Food heating systems according to other embodiments of the present disclosure can include electrical resistance heating element(s) that are positioned outside the rollers (e.g., located above or below the rollers). Food heating systems according to still other embodiments of the present disclosure can include inductive heating devices, radiant energy heating devices such as infrared lamps, or other types of heating devices.

Figure 5:
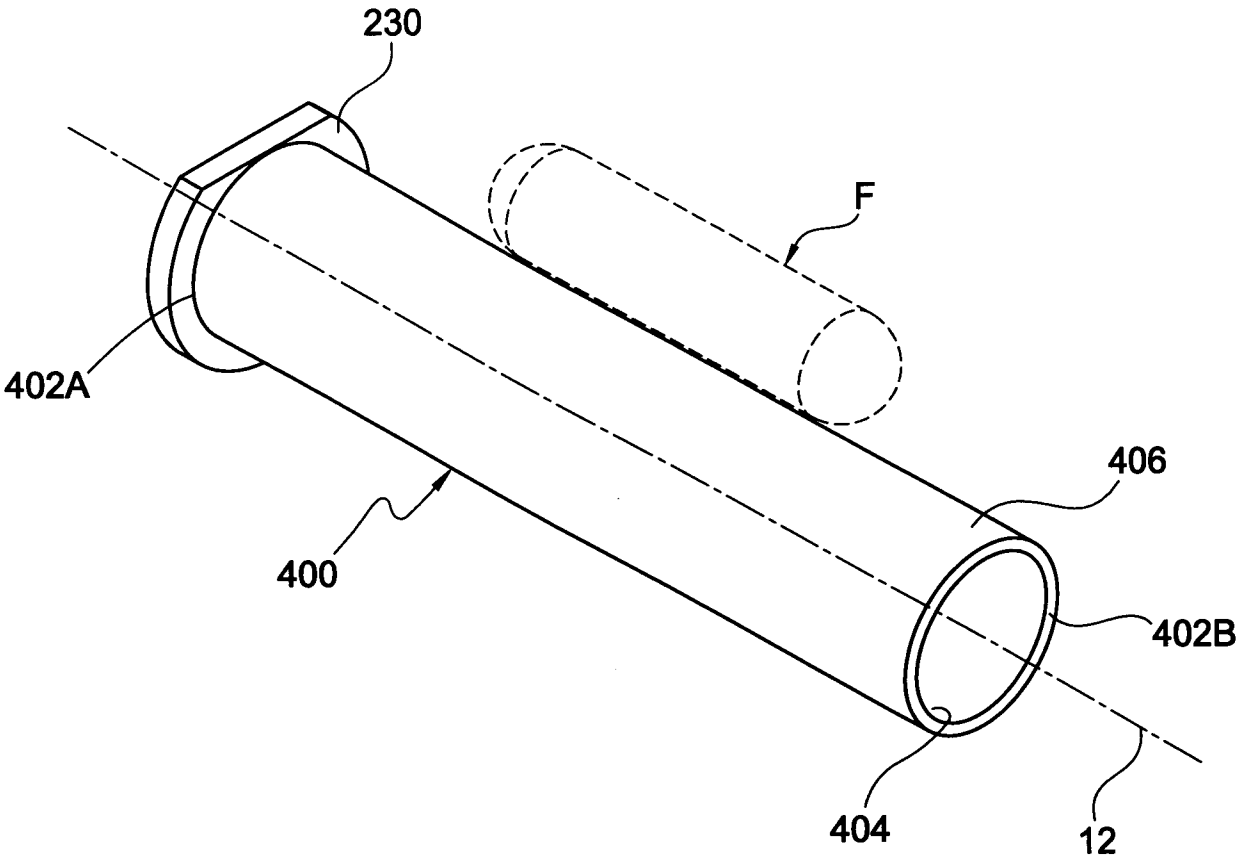
FIG. 5 is an isometric view showing an individual roller 400 of the food heater shown in FIG. 1.

FIG. 5 shows an individual roller 400 configured in accordance with an embodiment of the present disclosure. The roller 400 includes a tube having an interior surface 404 confronting the heating element 310 (FIG. 4) and an exterior surface 406 contiguously engaging the food product F, e.g., a hot dog. The roller 400 extends generally parallel to the axis 12 between a first end 402A rotatably supported by the first sidewall 110A (FIG. 1) and a second end 402B rotatably supported by the second sidewall 110B (also FIG. 1). The first end 402A can be configured with the connector 230. For example, in the embodiment shown in FIG. 5, the connector 230 is configured in accordance with the embodiment of the present disclosure described with respect to FIG. 3C.

Thus, according to embodiments of the present disclosure, the first end 312A of the heating element 310 (FIG. 4) is fixedly supported by the first sidewall 110A (FIG. 1), and the first end 402A of the roller 400 is releasably supported for relative rotation with respect to the first sidewall 110A (FIG. 1). A cleaning configuration or arrangement of the food heater 10 according to embodiments of the present disclosure permits the rollers 400 to be released with respect to the base structure 100, thereby facilitating removal, cleaning, reinstallation, replacement, etc. of the rollers 400. Two embodiments of the cleaning configuration or arrangement of the food heater 10 are described below with reference to FIGS. 6A and 6B.

Figure 6A:
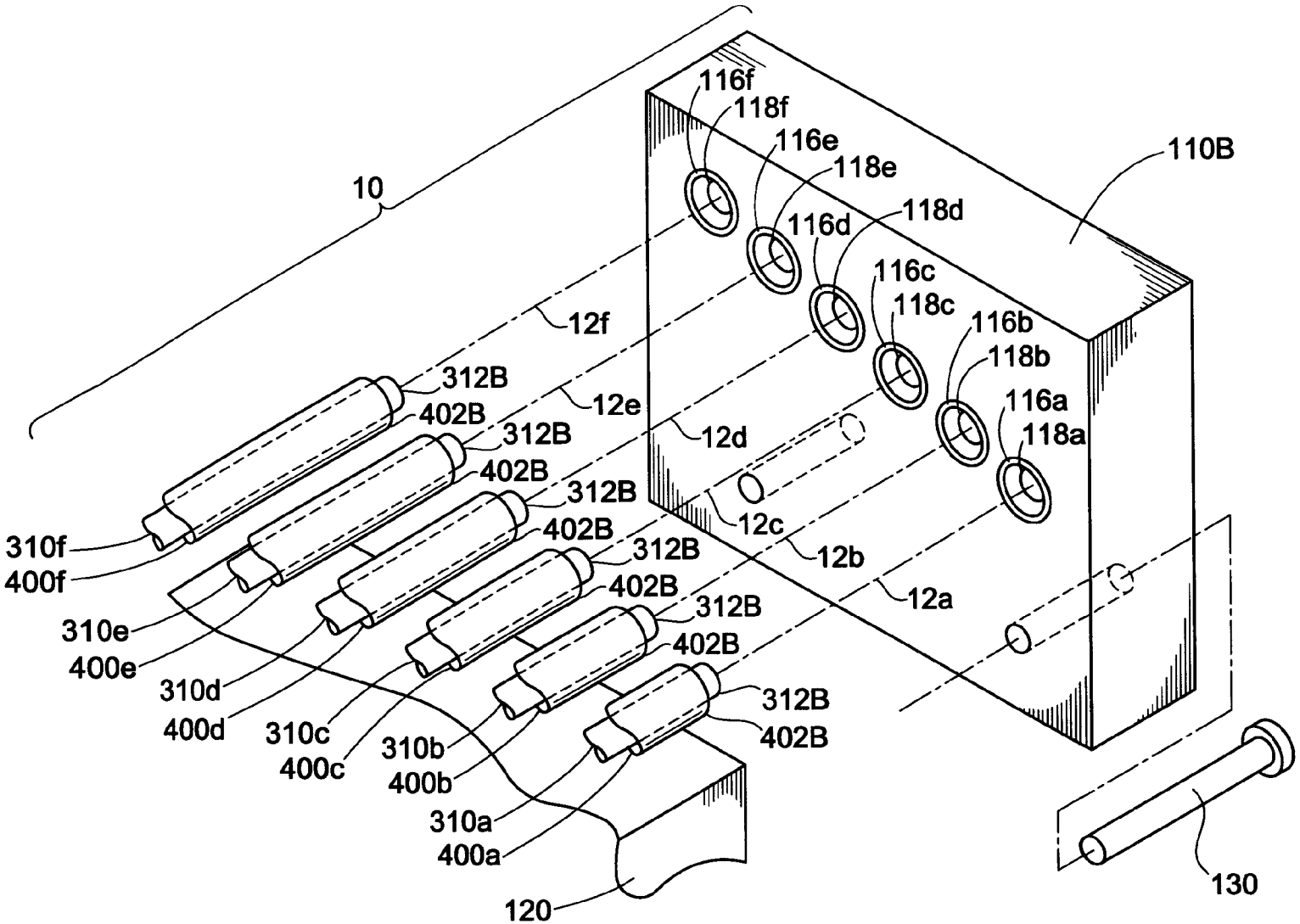
FIG. 6A is an exploded schematic isometric view illustrating a cleaning configuration according to a first embodiment of the present disclosure.

FIG. 6A illustrates a cleaning configuration or arrangement of the food heater 10 according to a first embodiment of the present disclosure. In the embodiment shown in FIG. 6A, the second sidewall 1108 can be releasably coupled to the enclosure 120 by one or more fasteners 130, e.g., hand knobs, screws, bolts, wing nuts, etc. The second sidewall 110B can include a plurality of bearings 116 (individual bearings 116*a* to 116*f* are shown in FIG. 6A) to support the second end 402B of the rollers 400*a* to 400*f*, respectively, and can include a plurality of fixtures 118 (individual fixtures 118*a* to 118*f* are shown in FIG. 6A) to cooperatively engage the second end 312B of the heating elements 310*a* to 310*f*, respectively. Individual bearings 116 act on the second end 402B of a corresponding roller 400 and can provide a force tending to avoid or prevent the axial displacement of the roller 400 away from a corresponding driven sprocket 224 (FIG. 2) in the coupled arrangement of the connector 230 (FIGS. 3A to 3D). Individual fixtures 118 can provide additional support for the second end 312B of a corresponding heating element 310. In the cleaning configuration or arrangement of the food heater 10 shown in FIG. 6A, the second sidewall 1108 is separated from the enclosure 120, thereby separating the bearings 116 from the second ends 402B of the rollers 400 and leaving the rollers 400 unsupported. This permits the first ends 402A (FIG. 5) of the rollers 400 to disengage or disconnect from the driven sprockets 224 (FIG. 2) at the connectors 230 (FIGS. 3A to 3D) and permits the rollers 400 to be displaced axially away from the driven sprockets 224 (FIG. 2). One or more of the rollers 400 can then be displaced relative to the corresponding heating elements 310, which remain secured with respect to the first sidewall 110A (FIG. 1).

Figure 6B:
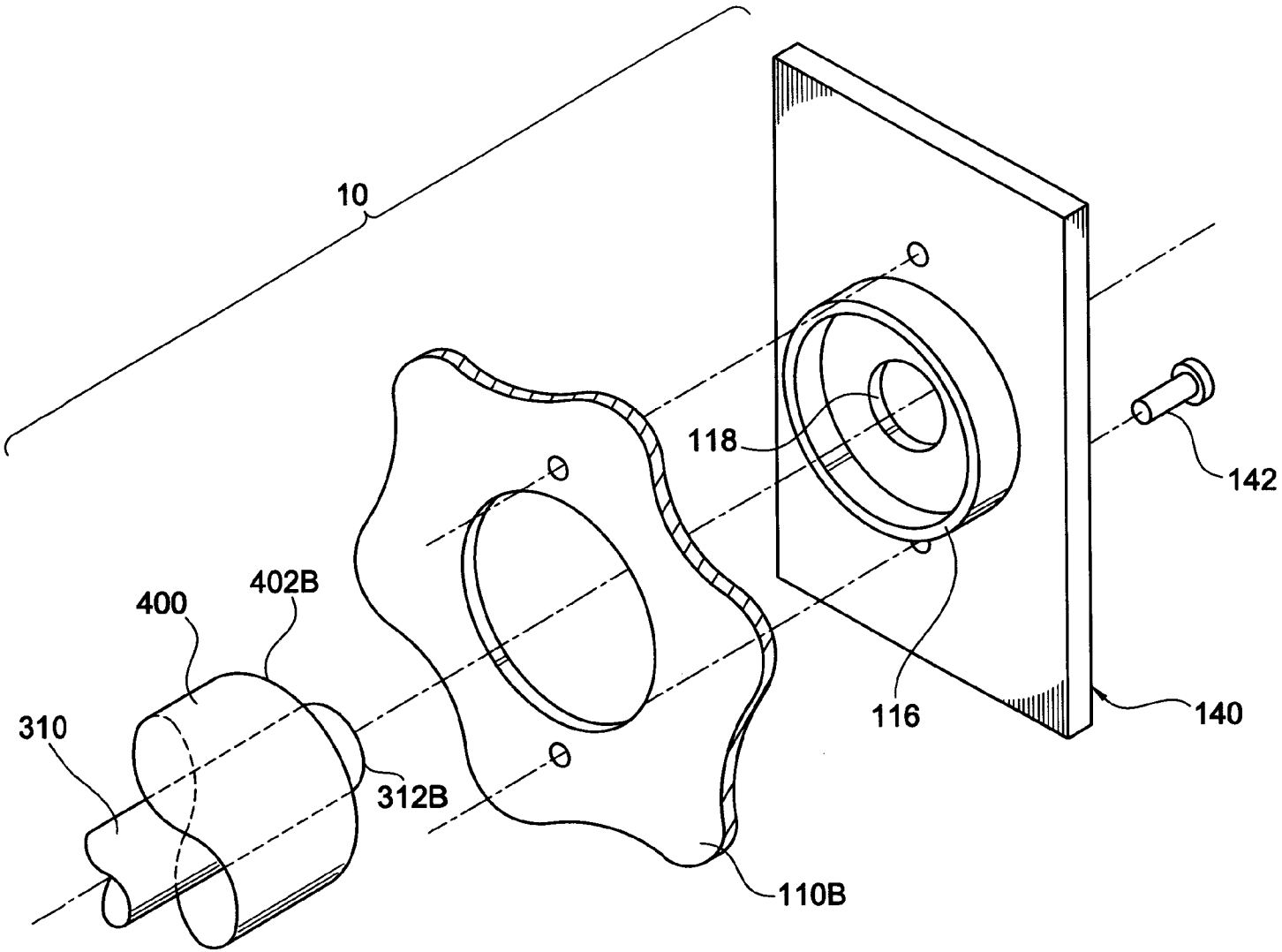
FIG. 6B is an exploded schematic isometric view illustrating a cleaning configuration according to a second embodiment of the present disclosure.

FIG. 6B illustrates a cleaning configuration or arrangement of the food heater 10 according to a second embodiment of the present disclosure. In the embodiment shown in FIG. 6B, the second sidewall 110B remains coupled to the enclosure 120 and individual inserts 140 can be releasably coupled to the second sidewall 110B by fasteners 142, e.g., hand knobs, screws, bolts, wing nuts, etc. Each insert 140 can include the bearing 116 to support the second end 402B of the roller 400 and can include the fixture 118 to cooperatively engage the second end 312B of the heating element 310. The bearing 116 acting on the second end 402B of the roller 400 can provide a force tending to avoid or prevent the axial displacement of the roller 400 away from the driven sprocket 224 (FIG. 2) in the coupled arrangement of the connector 230 (FIGS. 3A to 3D). The fixture 118 can provide additional support for the heating element 310 at the second end 312B. In the cleaning configuration of the food heater shown in FIG. 6B, an individual insert 140 is separated from second sidewall 110B, thereby separating the bearing 116 from the second end 402B of an individual roller 400 and leaving the rollers 400 unsupported. This permits the first end 402A (FIG. 5) of the individual roller 400 to disengage or disconnect from the corresponding driven sprocket 224 (FIG. 2) at the connector 230 (FIGS. 3A to 3D) and permits the individual roller 400 to be displaced axially away from the driven sprocket 224 (FIG. 2) and pass through an aperture in the second sidewall 110B. As in the embodiment shown in FIG. 5A, the individual roller 400 is displaced relative to the heating element 310, which remains secured with respect to the first sidewall 110A (FIG. 1).

According to embodiments of the present disclosure, the second end 402B of the roller 400 is left unsupported, either by separating the second sidewall 1108 from the enclosure 120 or by separating the insert 140 from the second sidewall 110B. In turn, the first end 402A of the roller 400 can be released or disconnected from the driven sprocket 224 at the coupling 230, and the roller 400 can be displaced axially with respect to the heating element 310, which remains fixed relative to the first sidewall 110A. Accordingly, the roller(s) 400 can be removed, cleaned separately, e.g., by submersion in a cleaning fluid (not shown), and subsequently reinstalled or replaced with respect to the base structure 100 of the heating unit 10. Additionally, with the rollers 400 removed, the base structure 100 can be cleaned separately, e.g., wiped down with cleaning fluid (not shown), and thereby avoid subjecting the controls in the control section 122, the rotating system 200, the heating system 300, and other components of the food heater 10 to potential damage that could result from being submersed in a liquid.

Embodiments according to the present disclosure can include a food heater having removable rollers that are releasable relative to a body of the food heater.

Embodiments according to the present disclosure can include a food heater with a releasable sidewall allowing a plurality of rollers to be decoupled and axially displaced for removal.

Embodiments according to the present disclosure can include a food heater having a sidewall with a releasable insert allowing individual rollers to be decoupled and axially displaced to be removed.

Embodiments according to the present disclosure can include a food heater having a removable roller that is axially displaceable with respect to a fixed heating element.

Embodiments according to the present disclosure can include a method of removing a roller of a food heater and cleaning the roller separately from the body of the food heater.

From the foregoing, it will be appreciated that specific embodiments of the invention have been described herein for purposes of illustration, but that various modifications may be made without deviating from the spirit and scope of the invention. Aspects of the invention described in the context of particular embodiments may be combined or eliminated in other embodiments. Furthermore, while advantages associated with certain embodiments of the invention have been described in the context of those embodiments, other embodiments may also exhibit such advantages, and not all embodiments need necessarily exhibit such advantages to fall within the scope of the invention.

I claim:

1. An apparatus for heating food, comprising:

a base including a first sidewall spaced from a second sidewall;

a plurality of rollers configured to support food and extending between the first and second sidewalls, wherein individual rollers extend along corresponding individual axes between a first end proximate the first sidewall and a second end proximate the second sidewall;

a driving system configured to rotate at least one roller with respect to the base for rotating the food, wherein the driving system includes:

a drive unit; and a plurality of driven units, wherein individual driven units are supported by the first sidewall and selectively configurable in a first arrangement to be operably coupled to the first end of a corresponding individual roller and in a second arrangement to be decoupled from the first end of the corresponding individual roller, and wherein the plurality of driven units operably couple the drive unit to the plurality of rollers when the driven units are in the first arrangement;

at least one heater configured to heat the at least one roller for heating the food; and at least one support configured to rotatably couple the second ends of the individual rollers to the second sidewall in the first arrangement, and decouple the second ends of the individual rollers from the second sidewall in the second arrangement.

2. The apparatus according to claim 1 wherein the base comprises a spacer extending between and coupling the first and second sidewalls in the first arrangement.

3. The apparatus according to claim 2 wherein the second sidewall is decoupled from the spacer in the second arrangement.

4. The apparatus according to claim 3 wherein the at least one support comprises a plurality of bearings supported by the second sidewall.

5. The apparatus according to claim 1 wherein, each roller comprises a tube having interior and exterior surfaces, wherein the interior surfaces of the individual tubes surround an individual heater, and wherein the exterior surface of the individual tube is configured to contiguously engage the food.

6. The apparatus according to claim 1 wherein the drive unit comprises:

a torque source;

a drive sprocket operatively coupled to the torque source; and a drive chain operatively coupled to the drive sprocket.

7. The apparatus according to claim 6 wherein the plurality of driven units comprise individual driven sprockets corresponding to individual rollers, and wherein the driven sprockets are operatively coupled to the drive chain.

8. The apparatus according to claim 1 wherein the first ends of individual rollers include first connectors and individual driven units include second connectors, the first and second connectors are operatively coupled in the first arrangement, and the first and second connectors are decoupled in the second arrangement.

9. The apparatus according to claim 8 wherein the first and second connectors comprise a projection and a recess, wherein the projection is received by the recess in the first arrangement, and wherein the projection is displaced out of the recess in the second arrangement.

10. The apparatus according to claim 8 wherein the first and second connectors comprises threads, wherein the threads are interengaged in the first arrangement, and wherein the threads are disengaged in the second arrangement.

11. The apparatus according to claim 8 wherein the first and second connectors comprise magnets, wherein a gap between the magnets is less than their interactive threshold in the first arrangement, and wherein the gap between the magnets is greater than their interactive threshold in the second arrangement.

12. The apparatus according to claim 1 wherein the at least one heater comprises a plurality of electrical resistance heating wires supported by the first sidewall.

13. The apparatus according to claim 1 wherein the at least one support comprises a plurality of inserts releasably coupled to the second sidewall, and wherein individual inserts rotatably support the second ends of individual rollers.

14. An apparatus for heating food, comprising:

a base;

a plurality of rollers rotatably supported by the base in a heating arrangement;

a driving system configured to rotate at least one roller for rotating the food in the heating arrangement;

means for temporarily disconnecting the at least one roller from the drive system in a cleaning arrangement; means for moving the at least one roller away from the base in the cleaning arrangement; and means for reconnecting the at least one roller to the drive system in the heating arrangement.

15. The apparatus according to claim 14, further comprising a heating system configured to heat the at least one roller for heating the food in the heating arrangement.

* * * * *

UNITED STATES PATENT AND TRADEMARK OFFICE

CERTIFICATE OF CORRECTION

PATENT NO. : 8,436,281 B2
APPLICATION NO. : 12/650181
DATED : May 7, 2013
INVENTOR(S) : Charles D. Cretors It is certified that error appears in the above-identified patent and that said Letters Patent is hereby corrected as shown below:

In the Specification

In column 3, line 18, delete “another” and insert -- another. --, therefor.

In column 3, line 48, delete “1228” and insert -- 122B --, therefor.

In column 6, line 24, delete “1108” and insert -- 110B --, therefor.

In column 6, line 41, delete “1108” and insert -- 110B --, therefor.

In column 7, line 16, delete “1108” and insert -- 110B --, therefor.

In the Claims

In column 8, line 36, in claim 5, delete “wherein,” and insert -- wherein --, therefor.

Signed and Sealed this
First Day of October, 2013

Teresa Stanek Rea
*Deputy Director of the United States Patent and Trademark Office*